US012116889B2

(12) United States Patent
Jones et al.

(10) Patent No.: US 12,116,889 B2
(45) Date of Patent: Oct. 15, 2024

(54) SINGLE SIDE DETERMINATION OF A FIRST FORMATION FLUID-SECOND FORMATION FLUID BOUNDARY

(71) Applicant: Halliburton Energy Services, Inc., Houston, TX (US)

(72) Inventors: Christopher Michael Jones, Houston, TX (US); Mehdi Ali Pour Kallehbasti, Houston, TX (US); Anthony Herman VanZuilekom, Houston, TX (US); Darren George Gascooke, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 175 days.

(21) Appl. No.: 17/857,489

(22) Filed: Jul. 5, 2022

(65) Prior Publication Data

US 2024/0011394 A1 Jan. 11, 2024

(51) Int. Cl.
*E21B 49/08* (2006.01)
*E21B 49/10* (2006.01)

(52) U.S. Cl.
CPC ..... *E21B 49/0875* (2020.05); *E21B 49/10* (2013.01); *E21B 2200/22* (2020.05)

(58) Field of Classification Search
CPC ..... E21B 43/20; E21B 49/008; E21B 49/10; E21B 49/0875
See application file for complete search history.

(56) References Cited

U.S. PATENT DOCUMENTS 3,068,355 A * 12/1962 Egan ..... E21B 47/047 436/28
3,193,004 A * 7/1965 Albright ..... E21B 43/20 166/252.4

(Continued)

FOREIGN PATENT DOCUMENTS

CN 101737033 A * 6/2010 ..... E21B 49/008
CN 111594148 A * 8/2020

(Continued)

*Primary Examiner* — Jennifer H Gay
(74) *Attorney, Agent, or Firm* — John Wustenberg; Parker Justiss, P.C.

(57) ABSTRACT

The disclosure presents processes to determine a first formation fluid-second formation fluid boundary from one side of the boundary utilizing a formation tester tool. For example, the formation tester can be utilized in a borehole to determine an engagement point with a subterranean formation and determine one or more, or a combination of, injectable fluids to inject into the subterranean formation. Sensors coupled to the formation tester can measure the rebound pressure of the injected fluids. In some aspects, the fluid density of the collected fluid can be measured. The measured pressure changes and other collected data, can be utilized to determine a first formation fluid-second formation fluid boundary parameter. Other characteristic parameters can also be determined such as wettability parameters, porosity parameters, and capillary effects parameters. The formation tester can collect a core sample and an analyzation of the core sample can be utilized to determine the characteristic parameters.

23 Claims, 7 Drawing Sheets

(56) References Cited

U.S. PATENT DOCUMENTS 4,638,864 A * 1/1987 Bousaid ..... E21B 43/162 166/269
5,148,705 A * 9/1992 Desbrandes ..... E21B 49/008 73/152.02
5,837,893 A * 11/1998 Chu ..... E21B 49/087 73/152.52
6,539,795 B1 * 4/2003 Scherpenisse ..... E21B 47/047 73/299
6,999,878 B2 * 2/2006 Manin ..... G01F 1/704 702/7
8,087,292 B2 * 1/2012 Voelker ..... E21B 49/008 73/152.41
9,399,913 B2 * 7/2016 Murphy ..... E21B 49/10
10,385,681 B2 * 8/2019 Chemali ..... E21B 47/13
10,444,402 B2 * 10/2019 Dubost ..... G06F 17/18
11,353,619 B2 * 6/2022 Chen ..... E21B 49/10
11,603,757 B2 * 3/2023 Proett ..... E21B 49/087
2002/0027004 A1 * 3/2002 Bussear ..... E21B 47/107 166/250.15
2004/0186666 A1 * 9/2004 Manin ..... G01F 1/704 702/12
2004/0263175 A1 * 12/2004 Chouzenoux ..... E21B 47/113 324/368
2005/0189142 A1 9/2005 Garcia et al.
2009/0008079 A1 * 1/2009 Zazovsky ..... E21B 43/2401 166/60
2009/0107669 A1 * 4/2009 Elphick ..... E21B 43/20 703/10
2009/0260884 A1 * 10/2009 Santelmann ..... E21B 44/00 175/74
2009/0272528 A1 * 11/2009 Voelker ..... E21B 49/008 166/64
2011/0251795 A1 10/2011 Difoggio
2011/0259581 A1 * 10/2011 Bedouet ..... E21B 49/10 166/250.03
2012/0092960 A1 * 4/2012 Gaston ..... G01V 1/226 367/35
2013/0317752 A1 * 11/2013 Dubost ..... E21B 49/008 702/12
2015/0013973 A1 * 1/2015 Murphy ..... E21B 49/10 166/250.15
2016/0290124 A1 * 10/2016 Chemali ..... E21B 47/113
2018/0010035 A1 * 1/2018 Gamage ..... E21B 49/08
2018/0196006 A1 * 7/2018 Capoglu ..... G01V 3/28
2020/0072042 A1 * 3/2020 Kim ..... E21B 43/162
2020/0217195 A1 7/2020 Proett
2021/0201178 A1 * 7/2021 Fanini ..... E21B 47/10
2021/0285297 A1 * 9/2021 Larsen ..... E21B 7/06
2021/0356619 A1 * 11/2021 Chen ..... G01R 33/448
2024/0011394 A1 * 1/2024 Jones ..... E21B 49/0875

FOREIGN PATENT DOCUMENTS

NO 322296 B1 * 9/2006 ..... E21B 44/00
WO 2011139570 A2 11/2011
WO WO-2021186202 A1 * 9/2021
WO WO-2024010575 A1 * 1/2024 ..... E21B 49/0875

* cited by examiner

SINGLE SIDE DETERMINATION OF A FIRST FORMATION FLUID-SECOND FORMATION FLUID BOUNDARY

TECHNICAL FIELD

This application is directed, in general, to analyzing subterranean formations and, more specifically, to determining formation fluid boundaries within the subterranean formation.

BACKGROUND

Data can be collected downhole when developing a borehole, such as performing drilling operations. The data can relate to where and how much hydrocarbons, such as oil and gas, are mixing with water. Generally, it is beneficial to develop the borehole in such a way as to minimize the mixing of the hydrocarbons and the water, since the water would need to be removed later. Being able to improve the determination of a boundary area of the hydrocarbons and water would be beneficial so that drilling operations can be adjusted to avoid exacerbating formation fluid mixing.

SUMMARY

In one aspect, a method is disclosed. In one embodiment, the method includes (1) positioning at a first location a formation tester within a borehole of a well site proximate a subterranean formation, (2) making a hydraulic seal of the formation tester with a fluid bearing formation, wherein the first location has at least a first formation fluid and a second formation fluid, where the first formation fluid and the second formation fluid are different phases, (3) measuring at least one fluid gradient utilizing at least one fluid pressure of an immobile phase fluid by injecting into the subterranean formation an injectable fluid miscible with the immobile phase fluid from the subterranean formation, wherein the immobile phase fluid is the first formation fluid, and (4) using the at least one fluid gradient to determine a first formation fluid-second formation fluid boundary, wherein the first formation fluid-second formation fluid boundary is a multiple phase boundary.

In a second aspect, a system is disclosed. In one embodiment, the system includes (1) a data transceiver, capable of receiving input parameters wherein the data transceiver is located downhole a borehole, and (2) a formation tester processor, capable of communicating with the data transceiver, determining one or more injectable fluids to utilize, collecting measurements from probes communicatively coupled to the formation tester processor, and determining a first formation fluid-second formation fluid boundary parameter, wherein the probes are located on one side of a first formation fluid-second formation fluid boundary.

In a third aspect, a computer program product having a series of operating instructions stored on a non-transitory computer-readable medium that directs a data processing apparatus when executed thereby to perform operations to determine a first formation fluid-second formation fluid boundary parameter is disclosed. In one embodiment, the operations include (1) directing a positioning at a first location a formation tester within a borehole of a well site proximate a subterranean formation, (2) instructing a making of a hydraulic seal of the formation tester with a fluid bearing formation, wherein the first location has at least a first formation fluid and a second formation fluid, where the first formation fluid and the second formation fluid are different phases, (3) calculating a measurement of at least one fluid gradient utilizing at least one fluid pressure of an immobile phase fluid by injecting into the subterranean formation an injectable fluid miscible with the immobile phase fluid from the subterranean formation, wherein the immobile phase fluid is the first formation fluid, and (4) using the at least one fluid gradient to determine a first formation fluid-second formation fluid boundary, wherein the first formation fluid-second formation fluid boundary is a multiple phase boundary.

BRIEF DESCRIPTION

Reference is now made to the following descriptions taken in conjunction with the accompanying drawings, in which.

DETAILED DESCRIPTION

Figure 1:
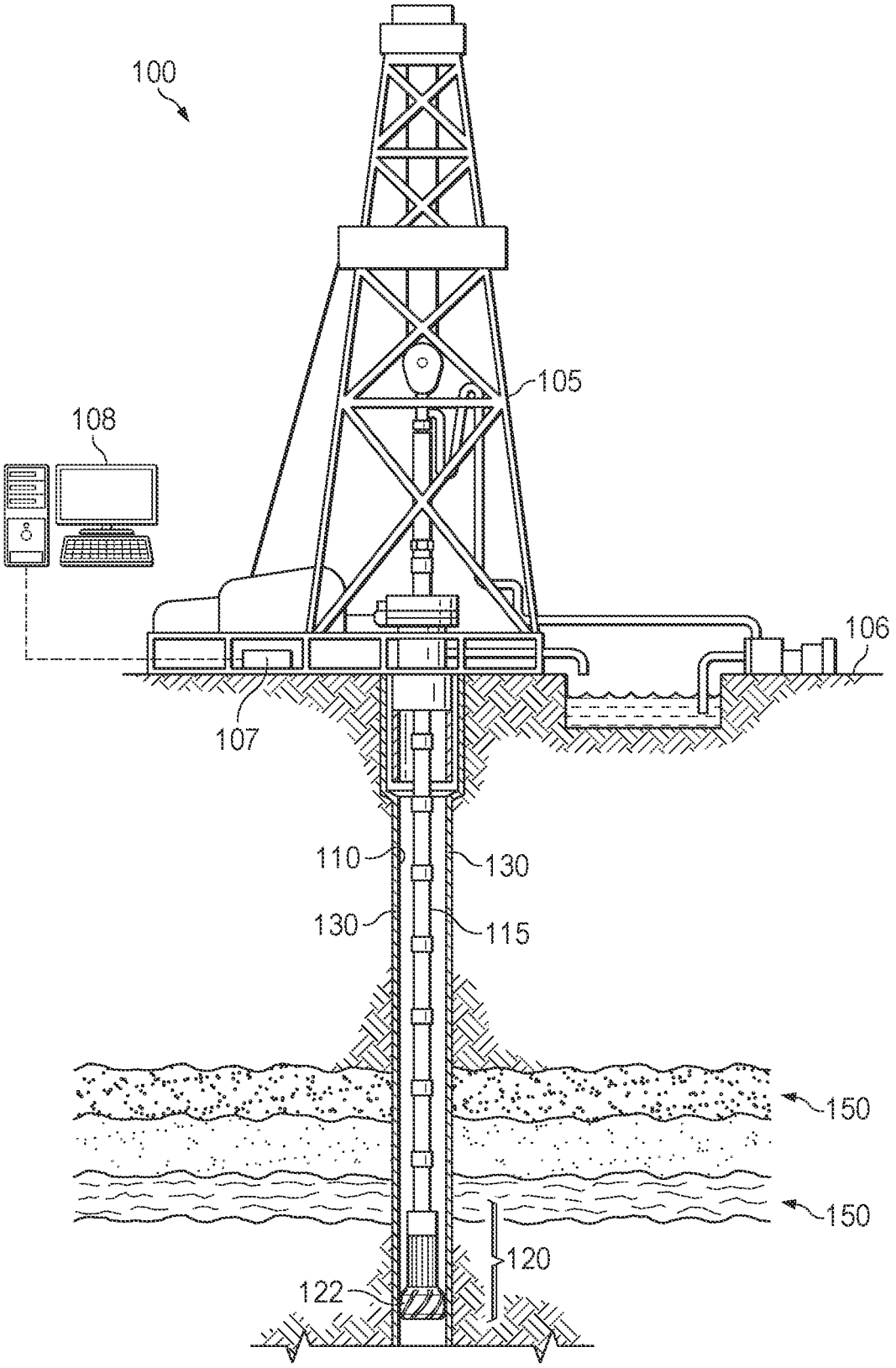
FIG. 1 is an illustration of a diagram of an example drilling system with a formation tester.

Developing a borehole, such as for scientific or hydrocarbon production purposes, can utilize data collected during operations, such as drilling operations or wireline operations. Other operations can be measuring while drilling (MWD), logging while drilling (LWD), seismic while drilling (SWD), and other borehole operation types. Various types of sensors can be utilized to collect the data, such as magnetic resonance, resistivity, acoustic, nuclear, temperature, pressure, and other sensor types. The data can be utilized by various borehole systems. For example, a geosteering system for a drilling bit can utilize the data to determine future steering directions to the drill bit or a well site controller can utilize the data to determine modifications to the well site operation plan.

In analyzing the collected data, a first formation fluid-second formation fluid boundary, e.g., a contact point, can be determined. The first formation fluid can be one of a hydrocarbon or water, and the second formation fluid can be one of a hydrocarbon or water. Hydrocarbons can be oil, gas, or other types of hydrocarbons. The first formation fluid and the second formation fluid are different fluid types, such as gas-oil, gas-water, oil-water, or other combinations of formation fluids. In current processes, the first formation fluid-second formation fluid boundary would need to be penetrated or crossed, such as by drilling through that portion of the subterranean formation in order to determine the boundary region. It would be beneficial to determine the boundary region of the first formation fluid-second formation fluid boundary from one side of the boundary, e.g., where the first formation fluid-second formation fluid boundary is not directly drilled through. This can improve the efficiency of drilling operations and reduce contamination of the hydrocarbons extracted from the borehole. Knowing where the first formation fluid-second formation fluid boundary is relative to the borehole and relative to other portions of the subterranean formation can be used to direct further drilling operations, such as directing a geo-steering system, or direct the operations of other borehole activities, such as locating an injection well or adjust hydraulic fracturing activities.

This disclosure presents processes where a first formation fluid-second formation fluid boundary, e.g., a formation fluid contact point or location in a portion of the subterranean formation (i.e., a multiple phase boundary), can be determined, thereby generating first formation fluid-second formation fluid boundary parameters. The subterranean formation is a fluid bearing formation. In some aspects, the first formation fluid-second formation fluid boundary parameters can be utilized to estimate reservoir reserves, or be utilized as inputs to determine where other evaluation boreholes, appraisal boreholes, injection boreholes, or production boreholes should be drilled. In some aspects, the first formation fluid-second formation fluid boundary parameters can be used as inputs into a geo-steering system or other borehole development systems, such as a well site controller or drilling controller.

In some aspects, the first formation fluid-second formation fluid boundary parameters can be utilized in conjunction with other collected or determined parameters, such as seismic data, resistivity data, or other log data to provide improved information to a user or to a borehole development system, such as a well site controller. The various types of determined and collected data can be from the same borehole, a proximate borehole, or in various combinations thereof.

The disclosed processes propose to inject a fluid compatible with a single-phase, such as the immobile phase fluid, into the subterranean formation and withdraw the fluid back into the formation tester as a sample. The single-phase, e.g., the immobile phase fluid, can be either hydrocarbon or water, depending on which side of the first formation fluid-second formation fluid boundary the formation tester is located. Various types of fluids can be used as the injectable fluid, for example, a hydrocarbon, a chemical, a drilling fluid, a mud, a brine, a water, a water with additives, and other types of injectable fluids.

The formation tester can include more than one type of injectable fluid and one of the injectable fluids can be selected to be injected into the formation using information about the fluid phase of the borehole fluids. In some aspects, a mix of injectable fluids can be utilized. In some aspects, one injectable fluid can be utilized to clean the subterranean formation area, and a second injectable fluid can be utilized for the measuring of the dilution or fluid pressure change parameters. In some aspects, the injectable fluid can be produced by the formation tester. In some aspects, the injectable fluid can be passed to the formation tester from another area or system, such as extracting fluid from the wellbore or from another downhole system. For example, if the borehole fluid is primarily an oil, then the injectable fluid can be water or brine. If the borehole fluid is primarily water, then a chemical or hydrocarbon can be used as the injectable fluid. In some aspects, the injectable fluid can include a marker, where the marker can be utilized to determine a fluid density of the withdrawn, e.g., sampled, fluid.

The formation tester can be one or more various tools, for example, a reservoir description tool, a mini drill string test (mini-DST) tool, or other types of downhole tools or sensors. The formation tester can be part of a drill string, part of a drilling assembly, part of a wireline tool, or part of other types of downhole tools.

In some aspects, the dilution parameter of the sample taken of the downhole fluid can be calculated by dilution of a marker that is in the injectable fluid. The marker can be of various types of chemical markers added to an injection fluid. In some aspects, the dilution can be directly measured when the injection fluid is of a different base than that the reservoir fluid. For example, when a water injectable fluid is injected into a hydrocarbon downhole fluid.

In some aspects, the downhole fluid, e.g., formation fluid, composition can be measured within the formation testing tool. In some aspects, the composition can be measured by taking a sample and transporting the sample to a testing tool at a different location, such as another location downhole or at a surface location. In this aspect, the fluid density of the formation fluid can be estimated, and subsequently the first formation fluid-second formation fluid boundary can be determined. The density can define a pressure fluid gradient. The intersection of the pressure fluid gradients for water and hydrocarbon are the contact boundaries. The intercept can be determined from the pressure measurement of the continuous phase. The density can be determined from two or more pressure points, or independently from a density measurement.

In some aspects, analysis can be performed using the relative fluid pressure of each phase on the injectable fluid at the time of injection. For example, an aqueous compatible phase can be injected and the subsequent fluid pressure asymptote can utilize the wettability or capillary effects relative to a hydrocarbon withdraw. In some aspects, an organic compatible phase can be injected and the subsequent fluid pressure asymptote can utilize the wettability or capillary effects relative to an aqueous withdraw. In some aspects, the injectable fluid can contain chemicals to change wettability parameters of the portion of the subterranean formation being tested in order to mobilize initial water in the formation. At least two sets of pressure points can be measured, such as one set for the hydrocarbon phase and one set for the aqueous phase. The pressure fluid gradients can be defined, the depth intersection of which is the estimate of the boundary. The interpretation of one of the sets of pressure fluid gradients can be made with at least one pressure measurement and one density measurement for that phase. Pressure fluid gradients can change based on fluid density and normally a regression method can be used to find the boundary. For example, oil has lower density than water, which means a lower pressure fluid gradient compared to water. Having the pressure measured at different depths of interest, density and contact boundaries can be found.

In some aspects, more than one location can be used to estimate the continuous phase fluid pressure gradient versus the discontinuous phase fluid estimate from above or below the first formation fluid-second formation fluid boundary. In some aspects, an initial mini-DST can be performed to remove particles from the formation wall, for example, to clean the borehole portion along the subterranean formation prior to injection of the injectable fluid. Sample measurements can be determined downhole, at a surface location proximate the borehole, in a laboratory, or location distant to the borehole to calculate the fluid gradient. Different types of petrophysical logs can be used to determine dominant rock types in the subterranean formation which can then be used to select an appropriate injectable fluid. In some aspects, multiple positions within the borehole can be used to improve the estimate of the first formation fluid-second formation fluid boundary. In some aspects, multiple injections and withdraws can be conducted at a one location to improve the exchange of formation fluid with the formation tester.

Turning now to the figures, FIG. 1 is an illustration of a diagram of an example drilling system 100 with a formation tester, for example, a logging while drilling (LWD) system, a measuring while drilling (MWD) system, a seismic while drilling (SWD) system, a telemetry while drilling (TWD) system, an injection well system, an extraction well system, and other borehole systems. Drilling system 100 includes a derrick 105, a well site controller 107, and a computing system 108. Well site controller 107 includes a processor and a memory and is configured to direct operation of drilling system 100. Derrick 105 is located at a surface 106.

Extending below derrick 105 is a borehole 110 with downhole tools 120 at the end of a drill string 115. Downhole tools 120 can include various downhole tools, such as a formation tester (e.g., a mini-DST) and a bottom hole assembly (BHA). There can be more than one formation tester located along drill string 115. At the bottom of downhole tools 120 is a drilling bit 122. Other components of downhole tools 120 can be present, such as a local power supply (e.g., generators, batteries, or capacitors), telemetry systems, sensors, transceivers, and control systems. Borehole 110 is surrounded by subterranean formation 150.

Well site controller 107 or computing system 108 which can be communicatively coupled to well site controller 107, can be utilized to communicate with downhole tools 120, such as sending and receiving acoustic data, telemetry, data, instructions, subterranean formation measurements, and other information. Computing system 108 can be proximate well site controller 107 or be a distance away, such as in a cloud environment, a data center, a lab, or a corporate office. Computing system 108 can be a laptop, smartphone, PDA, server, desktop computer, cloud computing system, other computing systems, or a combination thereof, that are operable to perform the processes described herein. Well site operators, engineers, and other personnel can send and receive data, instructions, measurements, and other information by various conventional means, now known or later developed, with computing system 108 or well site controller 107. Well site controller 107 or computing system 108 can communicate with downhole tools 120 using conventional means, now known or later developed, to direct operations of downhole tools 120.

Casing 130 can act as barrier between subterranean formation 150 and the fluids and material internal to borehole 110, as well as drill string 115. The formation tester can test the portion of the subterranean formation that is proximate the formation tester by injecting an injectable fluid into the subterranean formation and collecting resulting measurements, such as fluid pressure changes in the fluid, fluid density parameters, or dilution parameters. In some aspects, the formation tester can include a first formation fluid-second formation fluid boundary analyzer to perform an analyzation of the collected data. In some aspects, the first formation fluid-second formation fluid boundary analyzer can be part of other downhole tools.

In some aspects, the formation tester can communicate the collected data or the results to another system, such as computer system 108 or well site controller 107 where the first formation fluid-second formation fluid boundary parameters can be analyzed. In some aspects, computing system 108 can be the first formation fluid-second formation fluid boundary analyzer and can receive the formation tester data from one or more of the formation testers. In some aspects, well site controller 107 can be the first formation fluid-second formation fluid boundary analyzer and can receive the formation tester data from one or more of the formation tester tools. In some aspects, the first formation fluid-second formation fluid boundary analyzer can be partially included with well site controller 107 and partially located with computing system 108.

Figure 2:
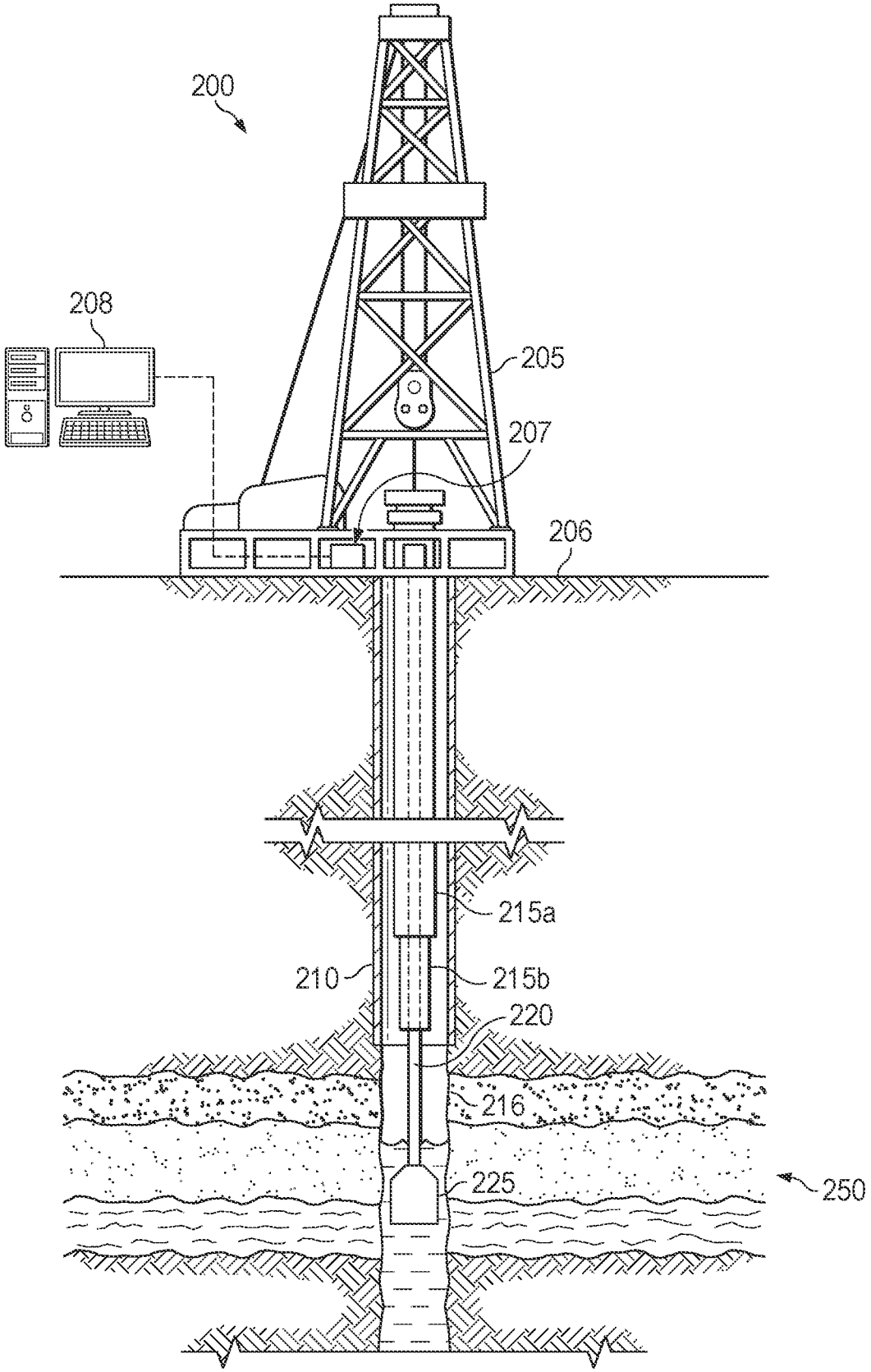
FIG. 2 is an illustration of a diagram of an example wireline system with a formation tester.

FIG. 2 is an illustration of a diagram of an example wireline system 200 with a formation tester. Wireline system 200 depicts a wireline well system and includes a derrick 205, a well site controller 207, and a computing system 208. Well site controller 207 includes a processor and a memory and is operable to direct operation of wireline system 200. Derrick 205 is located at a surface 206. Computing system 208 can be proximate well site controller 207 or be a distance away, such as in a cloud environment, a data center, a lab, or a corporate office. Computing system 208 can be a laptop, smartphone, PDA, server, desktop computer, cloud computing system, and other computing systems.

Extending below derrick 205 is a borehole 210, with a cased section 215*a*, a cased section 215*b*, and one uncased section 216. Wireline 220 is inserted in borehole 210 to hold a downhole tool 225. Borehole 210 is surrounded by a subterranean formation 250 which includes a hydrocarbon reservoir. Cased section 215*a* and cased section 215*b* can be designed to withstand subterranean formation 250 as well as the operations of downhole tool 225.

Downhole tools 225 can include one or more formation testers that can collect data on the subterranean formation and the fluids therein, and communicate the data to other tools or systems. In some aspects, downhole tools 225 can include a first formation fluid-second formation fluid boundary analyzer to analyze the collected data. The analyzed data can be communicated to one or more other systems, such as well site controller 207 or computing system 208. In some aspects, the data can be transmitted to another system, such as well site controller 207 or computing system 208. Well site controller 207 or computing system 208 can be a first formation fluid-second formation fluid boundary analyzer or a first formation fluid-second formation fluid boundary controller. In some aspects, the first formation fluid-second formation fluid boundary analyzer or a first formation fluid-second formation fluid boundary controller can be partially in well site controller 207, partially in computing system 208, partially in another computing system, or various combinations thereof.

In some aspects, the results of the first formation fluid-second formation fluid boundary analyzer or first formation fluid-second formation fluid boundary controller can be used to generate one or more view perspectives of the borehole and subterranean formations at the location of the formation tester. The view perspectives can be utilized by a user to determine whether changes or modifications are needed to the well site operations plan, such as adjusting drilling direction or other drilling parameters, for example, avoiding a water reservoir.

Figure 3:
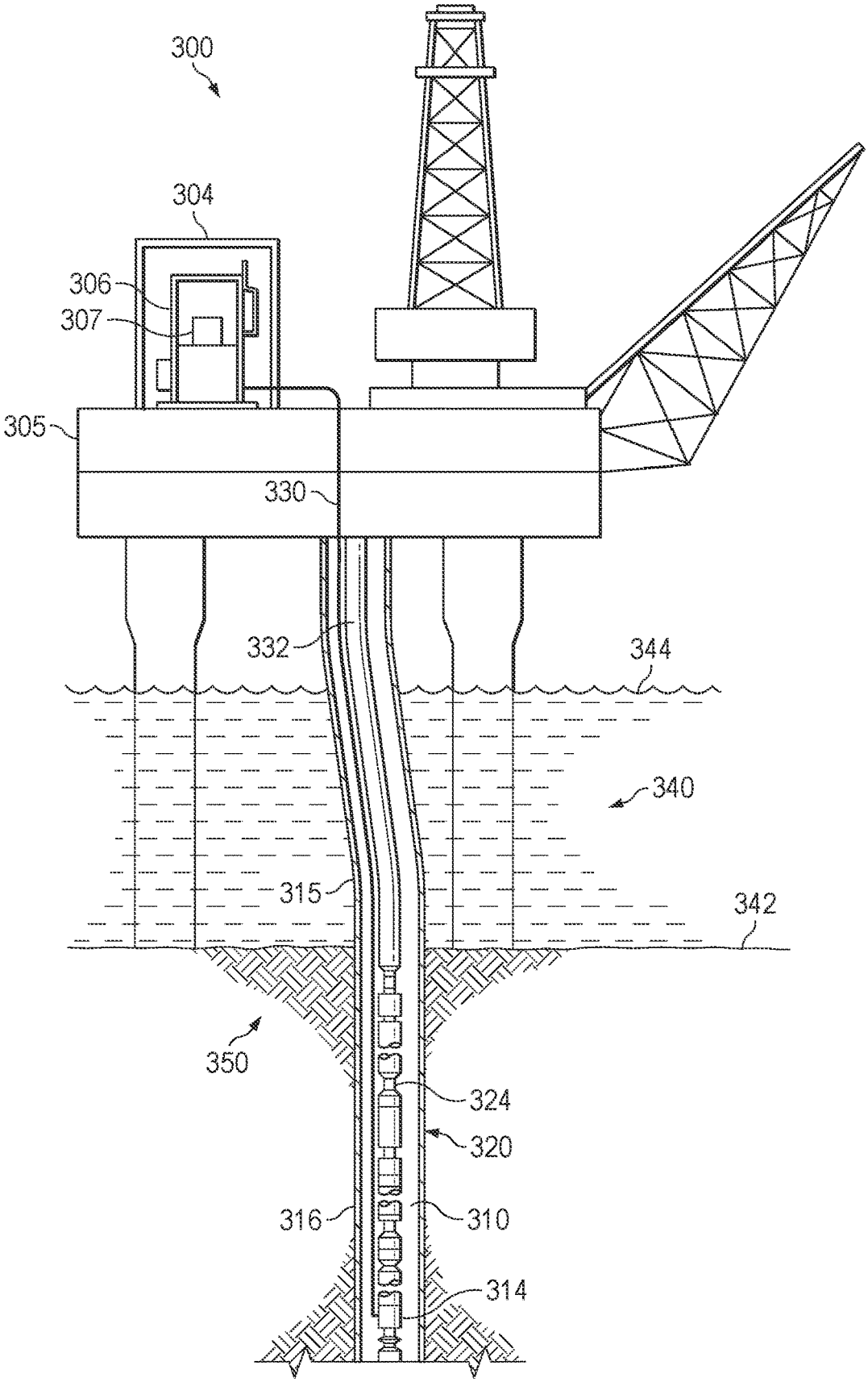
FIG. 3 is an illustration of a diagram of an example offshore system with a formation tester.

FIG. 3 is an illustration of a diagram of an example offshore system 300 with an electric submersible pump (ESP) assembly 320 and including a formation tester. ESP assembly 320 is placed downhole in a borehole 310 below a body of water 340, such as an ocean or sea. Borehole 310, protected by casing, screens, or other structures, is surrounded by subterranean formation 350. ESP assembly 320 can be used for onshore operations. ESP assembly 320 includes a well controller 307 (for example, to act as a speed and communications controller of ESP assembly 320), an ESP motor 314, and an ESP pump 324.

Well controller 307 is placed in a cabinet 306 inside a control room 304 on an offshore platform 305, such as an oil rig, above water surface 344. Well controller 307 is configured to adjust the operations of ESP motor 314 to improve well productivity. In the illustrated aspect, ESP motor 314 is a two-pole, three-phase squirrel cage induction motor that operates to turn ESP pump 324. ESP motor 314 is located near the bottom of ESP assembly 320, just above downhole sensors within borehole 310. A power/communication cable 330 extends from well controller 307 to ESP motor 314. A fluid pipe 332 fluidly couples equipment located on offshore platform 305 and ESP pump 324.

In some aspects, ESP pump 324 can be a horizontal surface pump, a progressive cavity pump, a subsurface compressor system, or an electric submersible progressive cavity pump. A motor seal section and intake section may extend between ESP motor 314 and ESP pump 324. A riser 315 separates ESP assembly 320 from water 340 until sub-surface 342 is encountered, and a casing 316 can separate borehole 310 from subterranean formation 350 at and below sub-surface 342. Perforations in casing 316 can allow the fluid of interest from subterranean formation 350 to enter borehole 310.

ESP assembly 320 can include a first formation fluid-second formation fluid boundary system, such as a formation tester, e.g., a RDT or other type of formation tester tool. In some aspects, ESP assembly 320 can include a first formation fluid-second formation fluid boundary analyzer to analyze the collected data. The analyzed data, e.g., results, can be communicated to one or more other systems, such as well controller 307. In some aspects, the collected data can be transmitted to another system, such as well controller 307. Well controller 307 can be a first formation fluid-second formation fluid boundary analyzer or a first formation fluid-second formation fluid boundary controller. In some aspects, the first formation fluid-second formation fluid boundary analyzer or the first formation fluid-second formation fluid boundary controller can be partially in well controller 307, partially in another computing system, or various combinations thereof. The results of the first formation fluid-second formation fluid boundary analyzer or first formation fluid-second formation fluid boundary controller can be used to generate recommendations to modify an existing well site operations plan.

FIGS. 1 and 2 depict onshore operations. Those skilled in the art will understand that the disclosure is equally well suited for use in offshore operations, such as shown in FIG. 3. FIGS. 1-3 depict specific borehole configurations, those skilled in the art will understand that the disclosure is equally well suited for use in boreholes having other orientations including vertical boreholes, horizontal boreholes, slanted boreholes, multilateral boreholes, and other borehole types.

Figure 4:
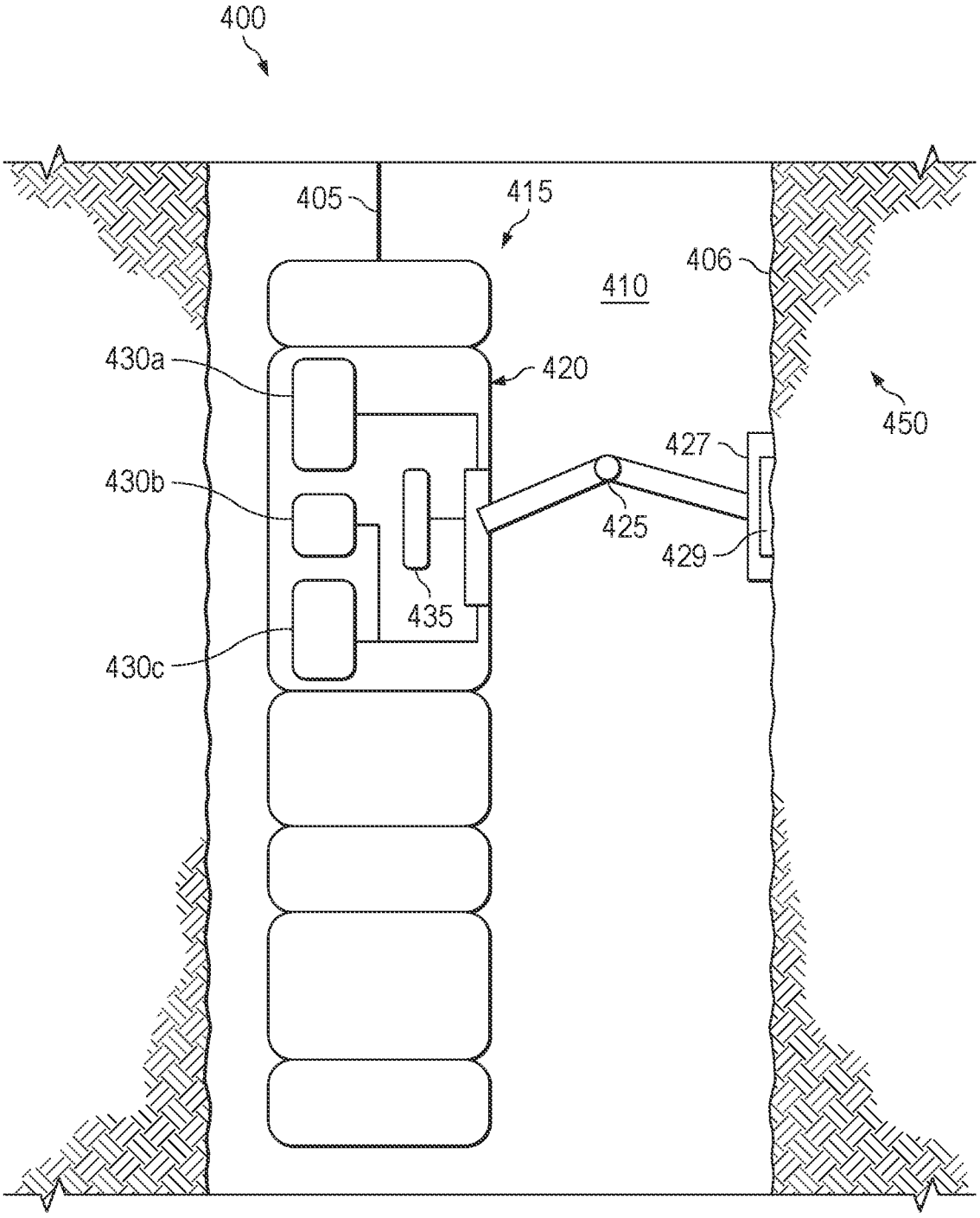
FIG. 4 is an illustration of a diagram of an example downhole tool system inclusive of a formation tester.
Figure 6:
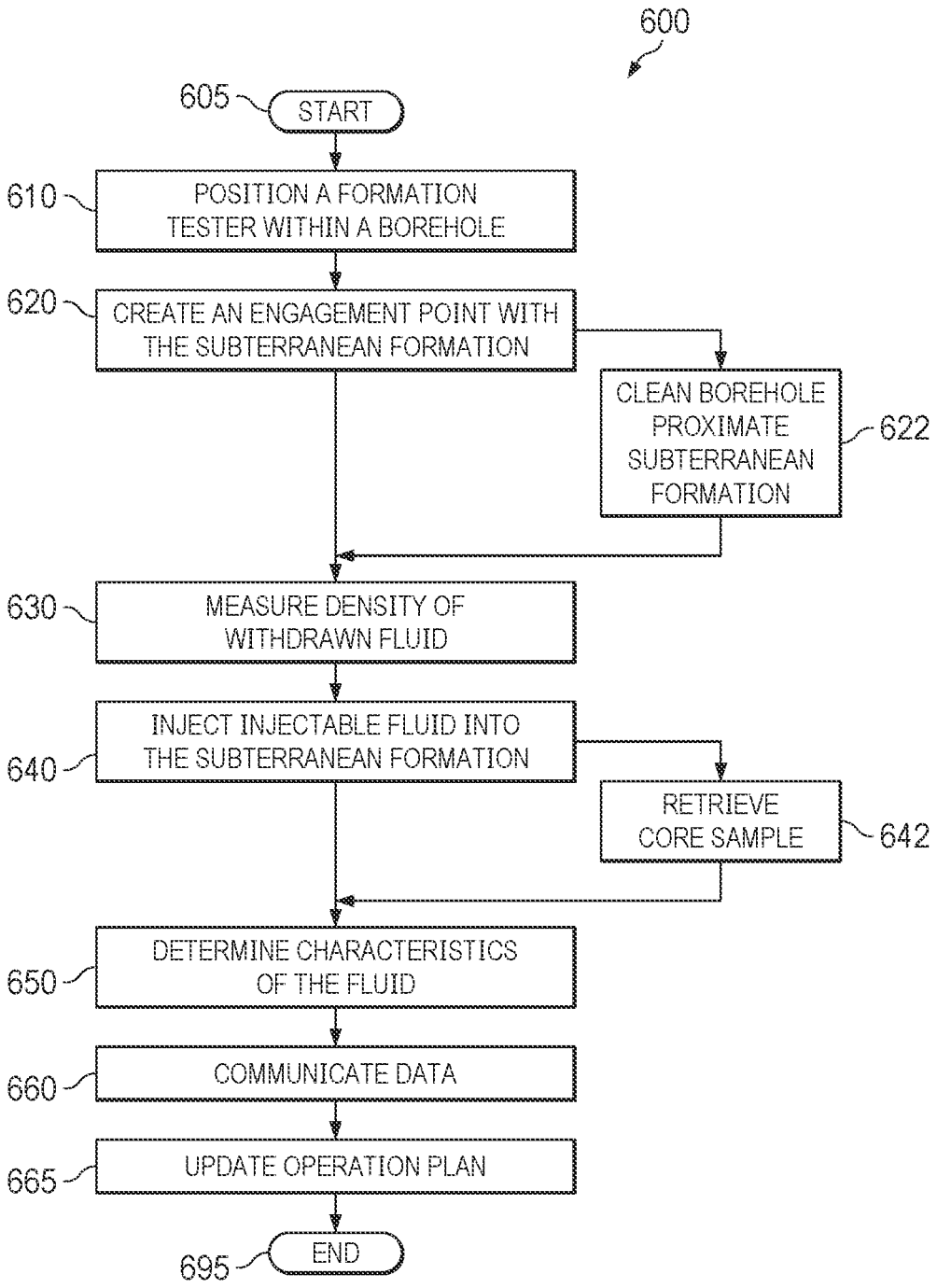
FIG. 6 is an illustration of a flow diagram of an example method to determine a first formation fluid-second formation fluid boundary.
Figure 7:
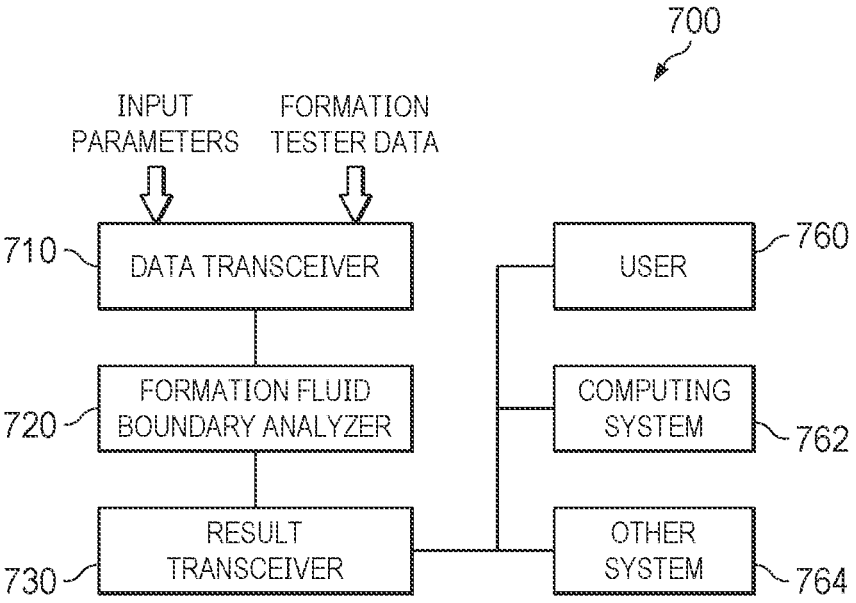
FIG. 7 is an illustration of a block diagram of an example first formation fluid-second formation fluid boundary system.
Figure 8:
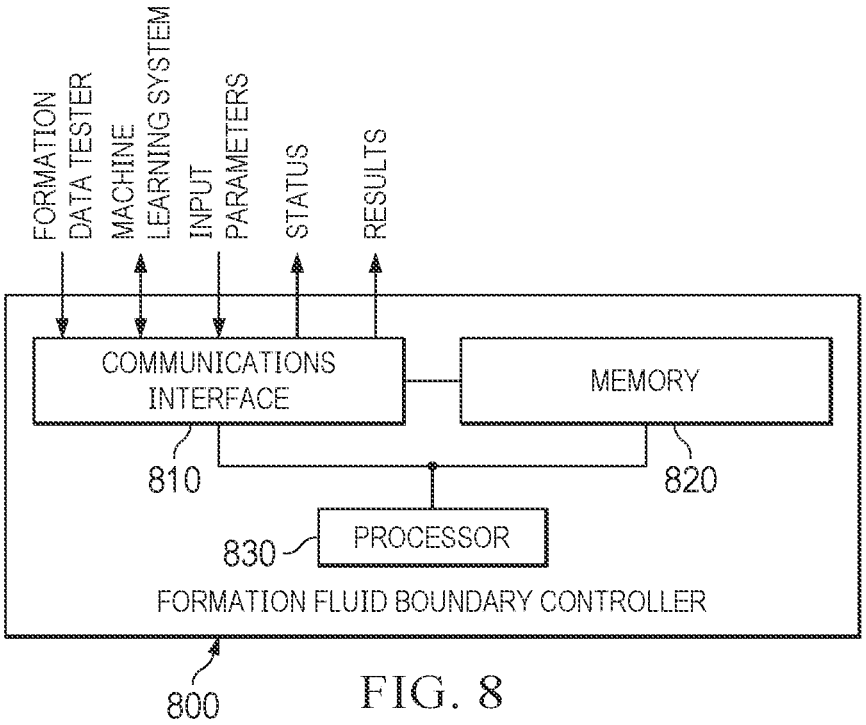
FIG. 8 is an illustration of a block diagram of an example of first formation fluid-second formation fluid boundary controller according to the principles of the disclosure.

FIG. 4 is an illustration of a diagram of an example downhole tool system 400 inclusive of a formation tester, such as demonstrated by first formation fluid-second formation fluid boundary analyzer system 700 of FIG. 7 or formation fluid boundary controller 800 of FIG. 8. Downhole tool 400 can be used by the methods and processes described herein to collect subterranean formation characteristic data that can be used to derive a determination of a first formation fluid-second formation fluid boundary, wettability, porosity, and permeability parameters (e.g., a set of characteristic parameters), such as using method 600 of FIG. 6. Downhole tool system 400 can be a downhole tool assembly, e.g., a permeability tool, an RDT, a mini-DST, and other types of downhole tools and can have one or more configurations. Downhole tool system 400 is capable of being mechanically, electrically, and communicatively coupled to other downhole tools and surface equipment.

In some aspects, downhole tool system 400 can be lowered into position within a borehole 410 by a wireline 405 attached to a downhole tool 415. In some aspects, downhole tool 415 can be attached to a drill string, a cable, a pipe, a tube, and other support mechanisms. Borehole 410 can be one of various types of boreholes, such as those illustrated in FIG. 1, FIG. 2, and FIG. 3. Downhole tool 415 can provide power to other coupled tools, and provide communications between sensors, tools, and surface equipment, such as controllers, e.g., well site controllers. Attached to downhole tool 415 is a formation tester 420. Formation tester 420 is mechanically, electrically, and communicatively coupled to downhole tool 415. Attached below formation tester 420 can be additional downhole tools, such as other testers, sensors, a geo-steering system, a drill bit assembly, or other types of downhole tools.

Formation tester 420 can collect subterranean formation data. In some aspects, formation tester 420 can include a processor or controller capable of directing the operations of formation tester 420, such as first formation fluid-second formation fluid boundary analyzer system 700 of FIG. 7 or formation fluid boundary controller 800 of FIG. 8. In some aspects, formation tester 420 can include a processor capable of calculating first formation fluid-second formation fluid boundary parameters, wettability parameters, capillary effect parameters, porosity parameters, and other subterranean formation characteristic parameters utilizing the collected data, e.g., the set of characteristic parameters. Formation tester 420 can include a communications system to communicate the collected data or the one or more various aforementioned parameters to one or more other systems. The other systems can be located proximate formation tester 420, located downhole, or located at a surface location.

Formation tester 420 has an articulation arm 425 with a subterranean formation seal 427 and fluid valves 429. Subterranean formation seal 427 is capable of creating a hydraulic seal with the subterranean formation. Injectable fluid storage 430*a*, injectable fluid storage 430*b*, and injectable fluid storage 430*c* (collectively injectable fluid storages 430) can each hold one of various types of injectable fluids, for example a water, chemicals that can be mixed with the water, a hydrocarbon, or other fluid types. A sample storage 435 can hold fluid or core samples taken from the subterranean formation for analysis by formation tester 420 or for transportation to the surface where other systems can perform the analysis. In some aspects, there can be fewer or additional storage systems for storing injectable fluids or storing retrieved fluids. In some aspects, there can be separate storage areas for core samples.

Articulation arm 425 can place subterranean formation seal 427 along an exposed area 406 of a subterranean formation 450. Depending on the type of fluid detected or determined in borehole 410, formation tester 420 can determine one or more types of injectable fluids to inject into subterranean formation 450. For example, if the fluid phase of fluids within borehole 410 is primarily a hydrocarbon, than a water can be injected. If the fluid phase is primarily a water, than a hydrocarbon can be injected. Other combinations can be determined in other aspects. The resulting mixed fluids can be analyzed by sensors in subterranean formation seal 427 or be withdrawn into formation tester 420 and stored in sample storage 435. In some aspects, a core sample can be taken and stored within formation tester 420 for further analysis. Core samples can be utilized to determine wettability, porosity, and other subterranean formation characteristic parameters.

Figure 5:
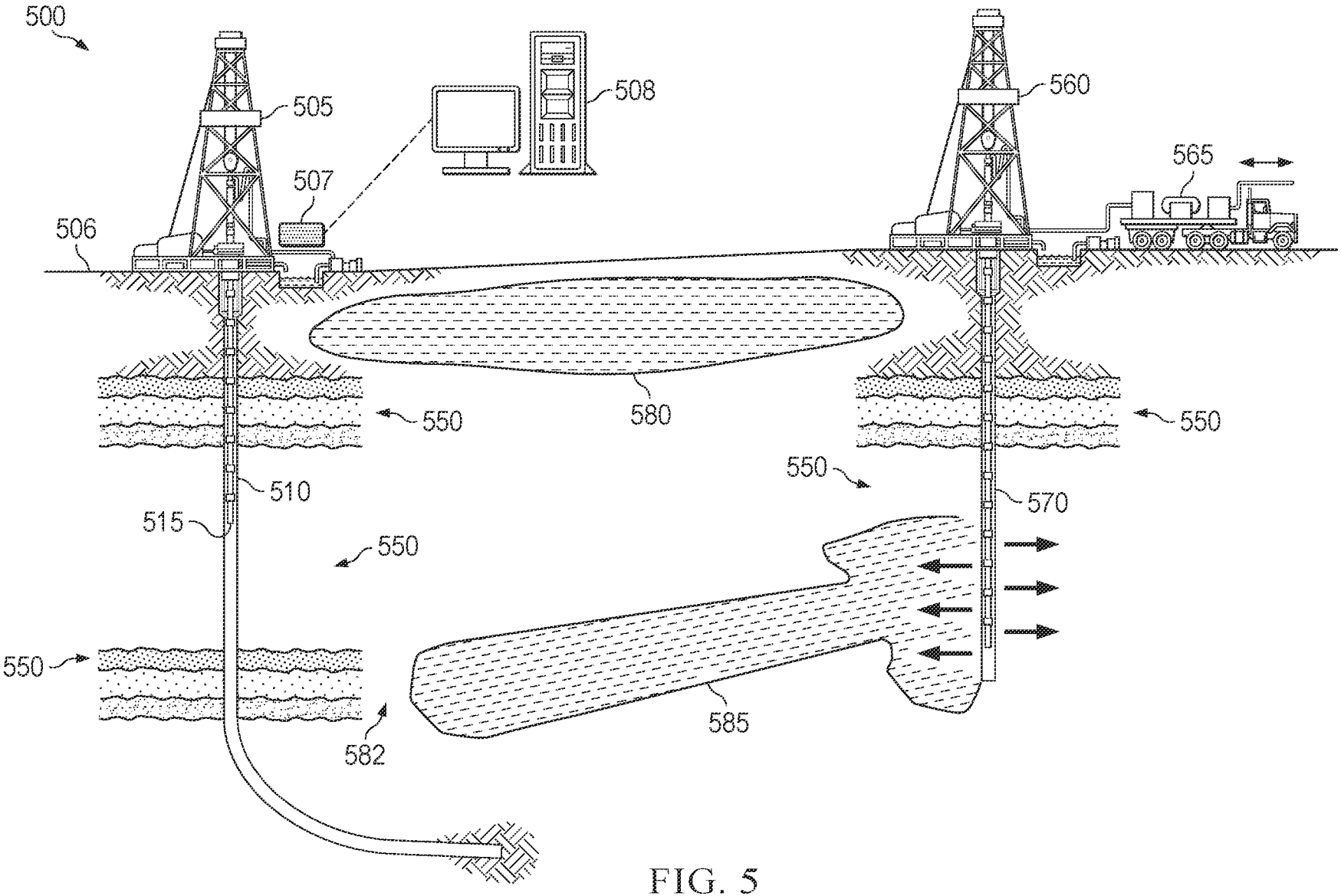
FIG. 5 is an illustration of a diagram of example well site demonstrating a first formation fluid-second formation fluid boundary detection.

FIG. 5 is an illustration of a diagram of an example well site 500 demonstrating first formation fluid-second formation fluid boundary detection. Well site 500 has a production borehole and an injection borehole, and two water reservoirs close to the production borehole. The processes disclosed herein can be utilized to identify the boundary between the water and hydrocarbon reservoirs in the subterranean formation.

Well site 500 includes a derrick 505 at a surface 506, a well site controller 507, and a computing system 508. Well site controller 507 can be positioned central to the well site operation or local to the one or more equipment devices to form a data network among other equipment devices or data transmitters. Well site controller 507 includes a processor and a memory, and is configured to direct operation of well site 500.

Extending below derrick 505 is a wellbore 510 with a fluid pipe 515 positioned within wellbore 510. Fluid pipe 515 is not complete and indicates that fluid pipe 515 can be extend with additional pipe segments to various lengths, with a maximum length being the length of wellbore 510. There can be downhole tools located at one or more locations within wellbore 510, for example at an end of fluid pipe 515, at one or more locations along a casing, or at one or more locations along wellbore 510 where there is no casing. The downhole tools can include various tools, such as formation testers, sensors, pumps, and other tools. Other components of downhole tools can be present, such as a local power supply (e.g., generators, batteries, or capacitors), telemetry systems, transceivers, and control systems. Wellbore 510 is surrounded by subterranean formation 550.

Well site controller 507 or computing system 508 which can be communicatively coupled to well site controller 507, can be utilized to communicate with the downhole tools, such as sending and receiving telemetry, data, instructions, subterranean formation characteristic parameters, wettability, porosity, and other information. Computing system 508 can be proximate well site controller 507 or be a distance away, such as in a cloud environment, a data center, a lab, or a corporate office. Computing system 508 can be a laptop, smartphone, PDA, server, desktop computer, cloud computing system, other computing systems, or a combination thereof, that are operable to perform the processes described herein. Well site operators, engineers, and other personnel can send and receive data, instructions, measurements, and other information by various conventional means, now known or later developed, with computing system 508 or well site controller 507. Well site controller 507 or computing system 508 can communicate with the downhole tools using conventional means, now known or later developed, to direct operations of the downhole tools.

Well site 500 includes an injection well 560 with a pumping system 565. Injection well 560 is pumping an injection fluid 585 downhole a wellbore 570, such as a water with or without additives. The arrows proximate wellbore 570 indicate that injection fluid 585 enters subterranean formation 550 at various locations. A water table 580 is present in this example.

A formation tester tool can be utilized at various locations within wellbore 510. For example, a formation tester can be located within wellbore 510 proximate water table 580. This formation tester can periodically perform the processes described herein. The resultant from the analysis of the data collected by the formation tester can be utilized to inform the well operations team on the integrity of water table 580, such as whether it is entering wellbore 510.

The analysis can be performed at the formation tester, or the collected data can be communicated to well site controller 507 or computing system 508 and the analysis performed in the respective receiving controller or system. In some aspects, the analysis can be performed partially in one controller or system, and partially in one or more other controllers or systems.

In a second example, a formation tester can be located further downhole wellbore 510, proximate a first formation fluid-second formation fluid boundary 582. The formation tester can perform the processes disclosed herein to determine an approximate position of first formation fluid-second formation fluid boundary 582. As injection well 560 pumps additional water downhole, first formation fluid-second formation fluid boundary 582 can move, such as moving closer to wellbore 510. The results from the analysis of the data collected by the formation tester can be used by the well site operation plan to adjust the operations of injection well 560.

FIG. 6 is an illustration of a flow diagram of an example method 600 to determine a first formation fluid-second formation fluid boundary. Method 600 can be performed on a computing system, for example, first formation fluid-second formation fluid boundary analyzer system 700 of FIG. 7 or formation fluid boundary controller 800 of FIG. 8. The computing system can be a well site controller, a geo-steering system, a resistivity system, a reservoir controller, a data center, a cloud environment, a server, a laptop, a mobile device, smartphone, PDA, or other computing system capable of receiving the formation tester data, input parameters, and capable of communicating with other computing systems. Method 600 can be encapsulated in software code or in hardware, for example, an application, code library, dynamic link library, module, function, RAM, ROM, and other software and hardware implementations. The software can be stored in a file, database, or other computing system storage mechanism. For example, at least of portion of the steps of method 600 can correspond to an algorithm represented by a series of operating instructions stored on a non-transitory computer readable medium. Method 600 can be partially implemented in software and partially in hardware. Method 600 can perform the steps for the described processes, for example, collecting data from the subterranean formation and analyzing the data.

Method 600 starts at a step 605 and proceeds to a step 610. In step 610, the formation tester can be positioned within a borehole. In some aspects, more than one formation tester, e.g., additional formation testers, can be utilized at various locations within the borehole, such as additional locations to where the first formation tester is located. In some aspects, the formation tester can be moved within the borehole after performing the method steps, and the method steps are repeated at the new location.

In a step 620, an engagement point with the subterranean formation can be created using a sensor tool, e.g., a probe tool, that is part of the formation tester. For example, the probe tool can be a packer or a pad, such as subterranean formation seal 427 of FIG. 4. In some aspects, method 600 can proceed optionally to a step 622. In some aspects, method 600 can proceed to a step 630.

In step 622, fluid can be withdrawn from the engagement point with the subterranean formation thereby cleaning the area proximate the engagement point. For example, mud cake can be cleaned from the borehole or drilling fluid filtrate can be removed from the engagement point with the subterranean formation. In some aspects, an injectable fluid can be used to clean the engagement point. Proceeding to step 630, the fluid density of the withdrawn fluid can be measured. The fluid density can be measured by the formation tester or the withdrawn fluid can be stored in the formation tester and transported to another system either downhole or at the surface for further analysis.

In a step 640, injectable fluid can be injected at the engagement point with the subterranean formation. The injectable fluid selected to be used can be determined utilizing an analysis of the previously withdrawn fluid, e.g., continuous phase injectable fluid or discontinuous phase injectable fluid. For example, the selected injectable fluid can be compatible with the discontinuous phase fluid of the withdrawn fluid. The injectable fluid can be a mix of fluids, such as water with chemical additives. In some aspects, method 600 can proceed optionally to a step 642. In some aspects, method 600 can proceed to a step 650.

In step 642, a core sample can be retrieved from the engagement point with the subterranean formation. The core sample can be analyzed by the formation tester or stored for later analysis by another system. The core sample can be representative of the subterranean formation from which the fluid withdraw and the injection of injectable fluids took place. Core samples can be utilized to determine various subterranean formation characteristic parameters, such as wettability and porosity.

Proceeding to step 650, characteristics of the withdrawn fluid can be measured and collected by the formation tester. For example, a continuous withdraw of fluid can be used to determine the fluid pressure of the continuous phase or a fluid pressure pulse as a transient. The rebound fluid pressure can be assumed to be the fluid pressure of the continuous phase as an asymptotic rebound fluid pressure. Upon injection with a miscible fluid with that of the discontinuous phase fluid, the injection fluid can make contact with the discontinuous phase fluid and the fluid pressure of the discontinuous phase fluid can be estimated as an asymptotic rebound fluid pressure. In this manner, the fluid pressure difference between the continuous phase and discontinuous phase can be measured and a capillary fluid pressure calculated.

The first formation fluid-second formation fluid saturation curve can be estimated and refined with multiple depth measurements, e.g., moving the formation tester or using more than one formation tester to take multiple measurements. Other log information, such as nuclear magnetic resonance (NMR), acoustic, resistivity, nuclear, or other types of sensor information, can be used to constrain the saturation curves, thereby improving the accuracy of the resultant determinations.

In some aspects, core analysis data can be used to constrain the saturation curves. Upon withdraw of the injected fluid from the subterranean formation, a dilution parameter can be calculated utilizing the characteristics of the injectable fluid and the withdrawn fluid which was sampled from the engagement point after the fluid made contact with the subterranean formation. The injectable fluid upon making contact with the subterranean formation can mix with the discontinuous phase fluid thereby diluting the injectable fluid. The dilution characteristics can be measured after the injectable fluid is withdrawn into the sensor. The chemical constitutes of the discontinuous phase fluid can be mixed within the withdrawn fluid. The dilution parameter as a function of depth can provide the water saturation profile, or be utilized to constrain an invert saturation curve with depth. The fluid dilution parameter can be used to estimate the density of a continuous phase by measurement indicative of density, and the dilution factor. For an undiluted sample, this dilution factor can be estimated as one (1). For a concentrated sample, the dilution factor can be above one, and for a diluted sample, the density can be lower than one.

When the injectable fluid is sampled back into the tool, it can be analyzed down hole, at a surface location, or in a laboratory. The fluid density of the discontinuous phase fluid can be calculated utilizing the dilution parameter and the chemical or physical properties measured downhole, by the surface system, or by the laboratory. In aspects where the engagement point is proximate the first formation fluid-second formation fluid boundary and where the phases are semi-continuous, each of the phases can be sampled, and the densities of each phase can be measured directly without the use of the dilution parameter. Knowing the fluid pressure of each phase and the fluid density of each phase, the first formation fluid-second formation fluid boundary can be estimated utilizing the intersection of the gradients of the fluid pressure and fluid density parameters. Further, the estimate can be refined utilizing the saturation curves which can be derived from the collected data.

Proceeding to a step 660, the collected data from the formation tester can be communicated to one or more systems. In aspects where the formation tester performs analysis on the collected data, such as analyzing the fluid density, fluid pressure, or composition of the collected fluid samples, the analysis can be communicated to one or more systems. In aspects where the formation tester can perform analysis on the core sample, the core sample analysis can likewise be communicated. In aspects where the fluid samples or core samples from the formation tester are analyzed by another system, than that other system can communicate the analysis results to one or more operational systems. For example, a surface core sample analyzer can communicate its results to the well site controller.

In a step 665, the received data or analysis can be utilized by one or more systems. The systems can be downhole systems, surface systems, or a combination thereof. For example, the data can be communicated to a geo-steering system allowing the drilling operations to continue in the hydrocarbon reservoir while minimizing interference from a water reservoir. The data can be communicated to a surface system, such as a well site controller or computing system and used as inputs into a well site operation planning process or used by a user in making subsequent well site operationally decisions. Method 600 ends at a step 695.

FIG. 7 is an illustration of a block diagram of an example first formation fluid-second formation fluid boundary analyzer system 700, which can be implemented in one or more computing systems, for example, a data center, cloud environment, server, laptop, smartphone, tablet, and other computing systems. In some aspects, first formation fluid-second formation fluid boundary analyzer system 700 can be implemented using a first formation fluid-second formation fluid boundary controller such as formation fluid boundary controller 800 of FIG. 8. First formation fluid-second formation fluid boundary analyzer system 700 can implement one or more methods of this disclosure, such as method 600 of FIG. 6.

First formation fluid-second formation fluid boundary analyzer system 700, or a portion thereof, can be implemented as an application, a code library, a dynamic link library, a function, a module, other software implementation, or combinations thereof. In some aspects, first formation fluid-second formation fluid boundary analyzer system 700 can be implemented in hardware, such as a ROM, a graphics processing unit, or other hardware implementation. In some aspects, first formation fluid-second formation fluid boundary analyzer system 700 can be implemented partially as a software application and partially as a hardware implementation. First formation fluid-second formation fluid boundary analyzer system 700 is a functional view of the disclosed processes and an implementation can combine or separate the described functions in one or more software or hardware systems.

First formation fluid-second formation fluid boundary analyzer system 700 includes a data transceiver 710, a formation fluid boundary analyzer 720, and a result transceiver 730. The results, e.g., a determination of the first formation fluid-second formation fluid boundary, a wettability parameter, a capillary effect parameter, a porosity parameter, other subterranean formation characteristics, and interim outputs from formation fluid boundary analyzer 720 can be communicated to a data receiver, such as one or more of a user or user system 760, a computing system 762, or other processing or storage systems 764. The results can be used to determine the directions provided to a geo-steering system or used as inputs into a well site controller or other borehole system, such as a well site operation planning system.

Data transceiver 710 can receive input parameters, such as parameters to direct the operation of the analysis implemented by formation fluid boundary analyzer 720, such as algorithms to utilize or a selection of which injectable fluids, or combination of injectable fluids, to inject into the subterranean formation. In some aspects, input parameters can include user inputs, such as a time to perform the formation testing or a location to perform the formation testing. In some aspects, data transceiver 710 can be part of formation fluid boundary analyzer 720.

Result transceiver 730 can communicate one or more results, analysis, or interim outputs, to one or more data receivers, such as user or user system 760, computing system 762, storage system 764, e.g., a data store or database, or other related systems, whether located proximate result transceiver 730 or distant from result transceiver 730. Data transceiver 710, formation fluid boundary analyzer 720, and result transceiver 730 can, or can include, conventional interfaces configured for transmitting and receiving data. In some aspects, formation fluid boundary analyzer 720 can be a machine learning system, such as providing a process to analyze the collected formation tester data against previously collected data within the current borehole or other boreholes and determining the first formation fluid-second formation fluid boundary and other borehole or geological characteristics (e.g., the set of characteristics parameters) from the historical data combined with the currently collected data. A final set of characteristic parameters can be determined from the current set of characteristic parameters combined with other sets of characteristic parameters or historical data.

Formation fluid boundary analyzer 720 can implement the analysis and algorithms as described herein utilizing the formation tester data and the input parameters. For example, formation fluid boundary analyzer 720 can perform the analysis of the formation tester data, determine a first formation fluid-second formation fluid boundary, and communicate the parameters to other systems, such as a geo-steering system or a well site operation plan system.

A memory or data storage of formation fluid boundary analyzer 720 can be configured to store the processes and algorithms for directing the operation of formation fluid boundary analyzer 720. Formation fluid boundary analyzer 720 can also include a processor that is configured to operate according to the analysis operations and algorithms disclosed herein, such as one or more algorithms corresponding to method 600, and an interface to communicate (transmit and receive) data.

FIG. 8 is an illustration of a block diagram of an example of formation fluid boundary controller 800 according to the principles of the disclosure. Formation fluid boundary controller 800 can be stored on a one computer or on multiple computers. The various components of formation fluid boundary controller 800 can communicate via wireless or wired conventional connections. A portion or a whole of formation fluid boundary controller 800 can be located at one or more locations (such as formation testers) and other portions of formation fluid boundary controller 800 can be located on a computing device or devices located at a surface location. In some aspects, formation fluid boundary controller 800 can be wholly located at a surface or distant location. In some aspects, formation fluid boundary controller 800 can be part of another system, and can be integrated in a one device, such as a part of a borehole operation planning system, a well site controller, a geo-steering system, or other borehole system.

Formation fluid boundary controller 800 can be configured to perform the various processes disclosed herein including receiving input parameters and collected data, and generating results from an execution of the methods and processes described herein, such as determining a first formation fluid-second formation fluid boundary parameter, wettability parameters, capillary effect parameters, porosity parameters, and other results and analysis (e.g., set of characteristic parameters). Formation fluid boundary controller 800 includes a communications interface 810, a memory 820, and a processor 830.

Communications interface 810 is configured to transmit and receive data. For example, communications interface 810 can receive the input parameters, and formation tester collected data. Communications interface 810 can transmit the generated results, data from the input files, or interim outputs. In some aspects, communications interface 810 can transmit a status, such as a success or failure indicator of formation fluid boundary controller 800 regarding receiving the various inputs, transmitting the generated results, or producing the generated results.

In some aspects, communications interface 810 can receive input parameters from a machine learning system, for example, where the collected formation tester data is processed using one or more filters and algorithms prior to determining the first formation fluid-second formation fluid boundary.

In some aspects, the machine learning system can be implemented by processor 830 and perform the operations as described by formation fluid boundary analyzer 720. Communications interface 810 can communicate via communication systems used in the industry. For example, wireless or wired protocols can be used. Communication interface 810 is capable of performing the operations as described for data transceiver 710 and result transceiver 730 of FIG. 7.

Memory 820 can be configured to store a series of operating instructions that direct the operation of processor 830 when initiated, including the code representing the algorithms for processing the collected data. Memory 820 is a non-transitory computer readable medium. Multiple types of memory can be used for data storage and memory 820 can be distributed.

Processor 830 can be configured to produce the generated results (e.g., set of characteristic parameters including determination of first formation fluid-second formation fluid boundary parameters, wettability, porosity, subterranean formation characteristic parameters surfaces, one or more interim outputs, and statuses utilizing the received inputs). Processor 830 can be configured to direct the operation of formation fluid boundary controller 800. Processor 830 can be a formation tester processor. Processor 830 includes the logic to communicate with communications interface 810 and memory 820, and perform the functions described herein. Processor 830 is capable of performing or directing the operations as described by formation fluid boundary analyzer 720 of FIG. 7.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, since the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Each of the aspects disclosed in the SUMMARY can have one or more of the following additional elements in combination. Element 1: wherein the at least one fluid gradient is measured utilizing a first pressure measurement at the first location and a second pressure measurement at a second location within the borehole, wherein the second location is at a different depth than the first location. Element 1: wherein the at least one fluid gradient is measured utilizing the at least one fluid pressure of the immobile phase fluid and a density measurement. Element 2: wherein the density measurement is measured at a different location within the borehole than the first location. Element 3: wherein the measuring at least one fluid gradient further comprises injecting the injectable fluid at a second location within the borehole. Element 4: wherein the at least one fluid gradient includes a second fluid gradient measured utilizing the second formation fluid and a second injectable fluid. Element 5: wherein the second fluid gradient is measured utilizing a second density measurement at the first location or a second location within the borehole. Element 6: wherein the second fluid gradient is measured utilizing a second pressure measurement measured at a second location within the borehole. Element 7: determining a final set of characteristic parameters utilizing the first formation fluid-second formation fluid boundary and the at least one fluid gradient. Element 8: communicating, using a result transceiver, the final set of characteristic parameters to a well site controller or a geo-steering system. Element 9: wherein the final set of characteristic parameters comprise one or more of a wettability parameter, a capillary effect parameter, or a porosity parameter. Element 10: wherein the wettability parameter, the capillary effect parameter, or the porosity parameter is determined using a first fluid pressure of the first formation fluid measured after a continuous phase injectable fluid is injected and a second fluid pressure of the first formation fluid measured after a discontinuous phase injectable fluid is injected. Element 11: wherein a core sample from the subterranean formation is retrieved by the formation tester, and an analysis of the core sample is utilized in the determining the final set of characteristic parameters. Element 12: wherein the injectable fluid is selected utilizing a fluid density, a characteristic parameter of the first formation fluid, and received inputs describing a type of subterranean formation. Element 13: wherein the immobile phase fluid is a hydrocarbon and the injectable fluid is a water. Element 14: wherein the first formation fluid is a water and the injectable fluid is a discontinuous phase fluid. Element 15: wherein the injectable fluid is one or more of a hydrocarbon, a chemical, a drilling fluid, a mud, a brine, a water, or a water with additives. Element 16: wherein the injectable fluid includes a marker, and the marker is utilized to determine a dilution parameter, where the dilution parameter is utilized to determine the first formation fluid-second formation fluid boundary. Element 17: a machine learning system, capable of communicating with the data transceiver and the formation tester processor, performing an analysis of the measurements, and generating one or more first formation fluid-second formation fluid boundary parameters. Element 18: a result transceiver, capable of communicating results, interim outputs, and the first formation fluid-second formation fluid boundary parameter to a user system, a data store, or a computing system. Element 19: wherein the computing system is a geo-steering system and the geo-steering system utilizes the first formation fluid-second formation fluid boundary parameter to adjust drilling operations. Element 20: wherein the computing system is a well site controller and the well site controller utilizes the first formation fluid-second formation fluid boundary parameter to adjust well site operation plans.

What is claimed is:

1. A method, comprising:

positioning, at a first location, a formation tester within a borehole, of a well site, proximate a subterranean formation;

making a hydraulic seal of the formation tester with a fluid bearing formation, wherein the first location has at least a first formation fluid and a second formation fluid, where the first formation fluid and the second formation fluid are different phases, the first formation fluid and the second formation fluid are fluids in the subterranean formation, and the phases comprise a hydrocarbon fluid phase or a water phase;

measuring at least one fluid gradient utilizing at least one fluid pressure of an immobile phase fluid by injecting, into the subterranean formation, an injectable fluid miscible with the immobile phase fluid, wherein the immobile phase fluid is the first formation fluid; and using the at least one fluid gradient to determine a first formation fluid-second formation fluid boundary, wherein the first formation fluid-second formation fluid boundary is a multiple phase boundary, and the first formation fluid-second formation fluid boundary is added to a first set of characteristic parameters as a first formation fluid-second formation fluid boundary parameter.

2. The method as recited in claim 1, wherein the at least one fluid gradient is measured utilizing a first pressure measurement at the first location and a second pressure measurement at a second location within the borehole, wherein the second location is at a different depth than the first location.

3. The method as recited in claim 1, wherein the at least one fluid gradient is measured utilizing the at least one fluid pressure of the immobile phase fluid and a density measurement of the immobile phase fluid.

4. The method as recited in claim 3, wherein the density measurement is measured at a different location within the borehole than the first location.

5. The method as recited in claim 1, wherein the measuring at least one fluid gradient further comprises:

injecting the injectable fluid at a second location within the borehole.

6. The method as recited in claim 1, wherein the at least one fluid gradient includes a second fluid gradient measured utilizing the second formation fluid and a second injectable fluid.

7. The method as recited in claim 6, wherein the second fluid gradient is measured utilizing a second density measurement of the second formation fluid at the first location or a second location within the borehole.

8. The method as recited in claim 6, wherein the second fluid gradient is measured utilizing a second pressure measurement measured at a second location within the borehole.

9. The method as recited in claim 1, further comprising:

determining a final set of characteristic parameters utilizing the first set of characteristic parameters and the at least one fluid gradient, wherein the final set of characteristic parameters further comprises one or more of a wettability parameter, a capillary effect parameter, a porosity parameter, a permeability parameter, or historical data.

10. The method as recited in claim 9, further comprising:

communicating, using a result transceiver, the final set of characteristic parameters to a well site controller or a geo-steering system.

11. The method as recited in claim 9, wherein the final set of characteristic parameters comprise one or more of the wettability parameter, the capillary effect parameter, or the porosity parameter, and the wettability parameter, the capillary effect parameter, or the porosity parameter is determined using a first fluid pressure of the first formation fluid measured after a continuous phase injectable fluid is injected and a second fluid pressure of the first formation fluid measured after a discontinuous phase injectable fluid is injected.

12. The method as recited in claim 11, wherein a core sample from the subterranean formation is retrieved by the formation tester, and an analysis of the core sample is utilized in the determining the final set of characteristic parameters.

13. The method as recited in claim 1, wherein the injectable fluid is selected utilizing a fluid density of the first formation fluid, a characteristic parameter of the first formation fluid, and received inputs describing a type of subterranean formation.

14. The method as recited in claim 1, wherein the immobile phase fluid is a hydrocarbon and the injectable fluid is a water.

15. The method as recited in claim 1, wherein the first formation fluid is a water and the injectable fluid is a discontinuous phase fluid.

16. The method as recited in claim 1, wherein the injectable fluid is one or more of a hydrocarbon, a chemical, a drilling fluid, a mud, a brine, a water, or a water with additives.

17. The method as recited in claim 1, wherein the injectable fluid includes a marker, and the marker is utilized to determine a dilution parameter, where the dilution parameter is utilized to determine the first formation fluid-second formation fluid boundary.

18. A system, comprising:

a data transceiver, capable of receiving input parameters, wherein the data transceiver is located downhole a borehole; and a formation tester processor, capable of communicating with the data transceiver, determining one or more injectable fluids to utilize, collecting measurements from a probe communicatively coupled to the formation tester processor, and determining a first formation fluid-second formation fluid boundary parameter using a first formation fluid and a second formation fluid that is a different phase from the first formation fluid, the phase is one of a hydrocarbon fluid phase or a water phase, the probe is located on one side of a first formation fluid-second formation fluid boundary, measuring at least one fluid gradient utilizing at least one fluid pressure of an immobile phase fluid by injecting, into the subterranean formation, the one or more injectable fluids that are miscible with the immobile phase fluid, the immobile phase fluid is the first formation fluid, and using the at least one fluid gradient to determine the first formation fluid-second formation fluid boundary parameter.

19. The system as recited in claim 18, further comprising:

a machine learning system, capable of communicating with the data transceiver and the formation tester processor, performing an analysis of the measurements, and generating one or more first formation fluid-second formation fluid boundary parameters.

20. The system as recited in claim 18, further comprising:

a result transceiver, capable of communicating results, interim outputs, and the first formation fluid-second formation fluid boundary parameter to a user system, a data store, or a computing system.

21. The system as recited in claim 20, wherein the computing system is a geo-steering system and the geo-steering system utilizes the first formation fluid-second formation fluid boundary parameter to adjust drilling operations.

22. The system as recited in claim 20, wherein the computing system is a well site controller and the well site controller utilizes the first formation fluid-second formation fluid boundary parameter to adjust well site operation plans.

23. A computer program product having a series of operating instructions stored on a non-transitory computer-readable medium that directs a data processing apparatus when executed thereby to perform operations to determine a first formation fluid-second formation fluid boundary parameter, the operations comprising:

directing a positioning, at a first location, a formation tester within a borehole, of a well site, proximate a subterranean formation;

instructing a making of a hydraulic seal of the formation tester with a fluid bearing formation, wherein the first location has at least a first formation fluid and a second formation fluid, where the first formation fluid and the second formation fluid are different phases, the first formation fluid and the second formation fluid are fluids in the subterranean formation, and the phases comprise a hydrocarbon fluid phase or a water phase;

calculating a measurement of at least one fluid gradient utilizing at least one fluid pressure of an immobile phase fluid by injecting, into the subterranean formation, an injectable fluid miscible with the immobile phase fluid, wherein the immobile phase fluid is the first formation fluid; and using the at least one fluid gradient to determine a first formation fluid-second formation fluid boundary, wherein the first formation fluid-second formation fluid boundary is a multiple phase boundary, and the first formation fluid-second formation fluid boundary is added to a first set of characteristic parameters as a first formation fluid-second formation fluid boundary parameter.

* * * * *